US006763692B1

(12) United States Patent
Huang

(10) Patent No.: US 6,763,692 B1
(45) Date of Patent: Jul. 20, 2004

(54) ANNULAR KEY COLLECTING DEVICE

(76) Inventor: Yu-Hwei Huang, No. 8, Lane 42, Sec. 2, Nan-Kan Road, Lou-Choo Hsiang, Tao-Yuan Hsien (TW)

( * ) Notice: Subject to any disclaimer, the term of this patent is extended or adjusted under 35 U.S.C. 154(b) by 0 days.

(21) Appl. No.: 10/428,028

(22) Filed: May 2, 2003

(51) Int. Cl.[7] ..... A44B 15/00
(52) U.S. Cl. ..... 70/456 R; 24/3.6; 70/459
(58) Field of Search ..... 70/456 R, 457, 70/458, 459, 460; 24/483, 590.1, 663, 3.6; 206/37.1, 37.4, 37.5, 37.8, 38.1

(56) References Cited

U.S. PATENT DOCUMENTS

| | | | | | |
|---|---|---|---|---|---|
| 293,693 | A | * | 2/1884 | West | |
| 368,135 | A | * | 8/1887 | Crandall | |
| 3,478,550 | A | * | 11/1969 | Salvesen | |
| 3,776,009 | A | * | 12/1973 | MacGlashan | 70/459 |
| 4,129,021 | A | * | 12/1978 | Brentini | 70/456 R |
| 5,528,916 | A | * | 6/1996 | Song | 70/459 |
| 5,617,751 | A | * | 4/1997 | Song | 70/456 R |
| 5,685,185 | A | * | 11/1997 | MacDonald | 70/459 |
| 5,806,356 | A | * | 9/1998 | Lee | 70/456 R |

FOREIGN PATENT DOCUMENTS

| | | | | |
|---|---|---|---|---|
| CA | 604747 | * | 9/1960 | 70/459 |
| DE | 318207 | * | 1/1920 | 70/459 |
| DE | 2852039 | * | 9/1979 | 70/459 |
| FR | 854204 | * | 4/1940 | 70/459 |
| FR | 1224203 | * | 6/1960 | 70/459 |
| GB | 344178 | * | 3/1931 | 70/459 |

* cited by examiner

*Primary Examiner*—Lloyd A. Gall
(74) *Attorney, Agent, or Firm*—Troxell Law Office PLLC

(57) ABSTRACT

The key collecting device comprises an upper and a lower housing each having a central base portion extending radially outwardly to form spaced spokes mutually opposite to the corresponding ones of themselves, every two of the spaced spokes opposite to each other form an operation space with the other two. The spokes have pairs of mutually opposite curved recesses mutually connected to form clamping channels for an annular ring with a notch. These housings further have a pair of mutually opposite recesses communicating with a corresponding one of the curved recesses for placing therein a slide-controlling member to be moved from outside to control closing and opening of the annular ring being movably positioned between these housings and controlled to rotate and moved into the interior of a pair of the spaced spokes opposite to each other, or to an operation space between two pairs of the mutually opposite spaced spokes. The device is more convenient for operation and its strength is increased when the annular ring is positioned.

6 Claims, 5 Drawing Sheets

ANNULAR KEY COLLECTING DEVICE

BACKGROUND OF THE INVENTION

1. Field of the Invention

The present invention is related to an annular key collecting device, and especially to an annular key collecting device making a larger operation space for mounting and detaching keys as well as increasing the entire structural strength of the annular key collecting device.

2. Description of the Prior Art

Key collecting rings with two circles each made in the early stages are difficult and inconvenient in putting in and taking out keys; as a result, the key collecting devices used nowadays are mostly in the shapes of disks. Such a disk-like key collecting device basically is provided with an external peripheral groove in which at a specific position there is provided an access for keys in communication with the external peripheral groove, the access for keys can be controlled for closing or opening with a slide pin provided. By the fact that the access for keys is quite narrow, it is inconvenient generally for a finger to do a rather delicate handling action.

Thereby, some key collecting device has a rotatable ring mounted on the top end of the main body thereof, the ring is provided with a notch as an access hole for keys. The notch of the ring is moved by rotating into the main body normally to form a closing state, and can be exposed by rotating outwardly for putting in or taking out keys. However, the ring of quite a diameter and with an empty inner space extends out of the main body of the key collecting device quite roughly, this not only affects the entire esthetic appearance of the product, but also is subjected to damage by inadvertent collision.

SUMMARY OF THE INVENTION

The object of the present invention is to provide an annular key collecting device having an annular ring of a predetermined diameter, the ring is provided with a notch as an access for keys, and is positioned in a plurality of spaced curved recesses formed on an upper housing and a lower housing opposite to each other. A slide-controlling member is provided in the upper and the lower housings and has a front end at least having a width in coincident with that of the notch of the ring, the slide-controlling member normally latches the notch of the ring, and can contract to set the notch of the ring free by a force. In a preferred embodiment, the upper and the lower housings have a plurality of spaced spokes for movably clamping the annular ring, every two of the spaced spokes opposite to each other form a space for operation with the other two of the spaced spokes opposite to each other when the notch of the ring is exposed by rotating.

The present invention will be apparent after reading the detailed description of the preferred embodiments thereof in reference to the accompanying drawings.

DETAILED DESCRIPTION OF THE PREFERRED EMBODIMENT

Figure 1:
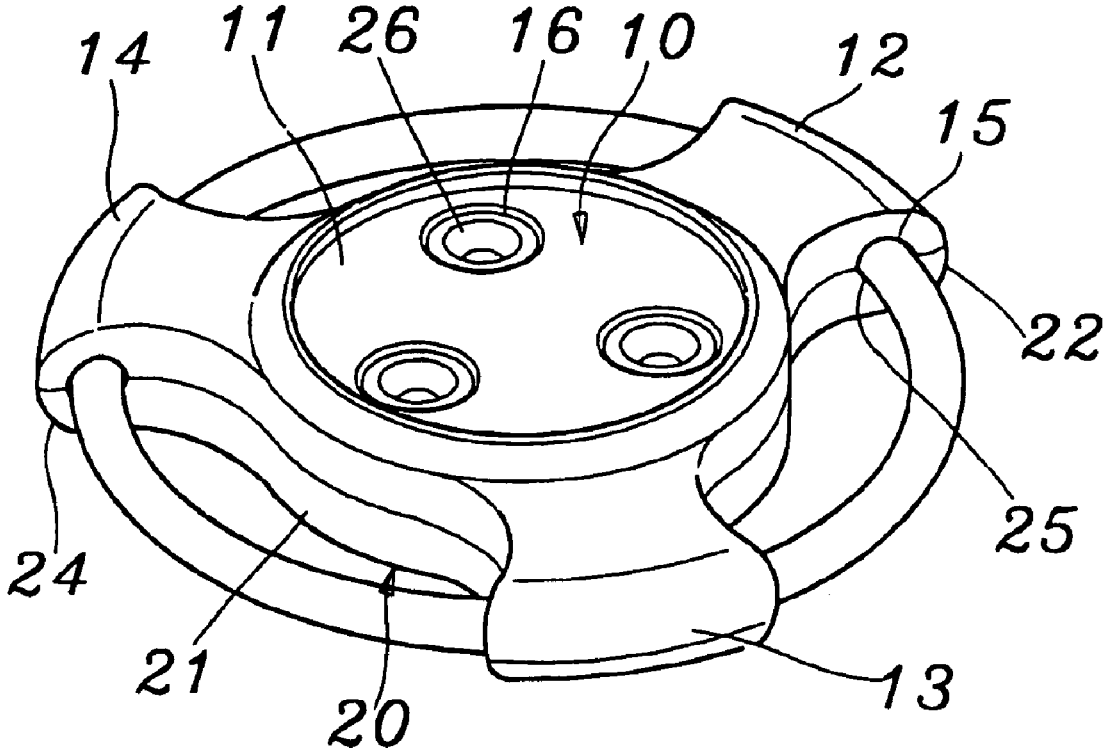
FIG. 1 is a perspective view of a preferred embodiment of the present invention.
Figure 2:
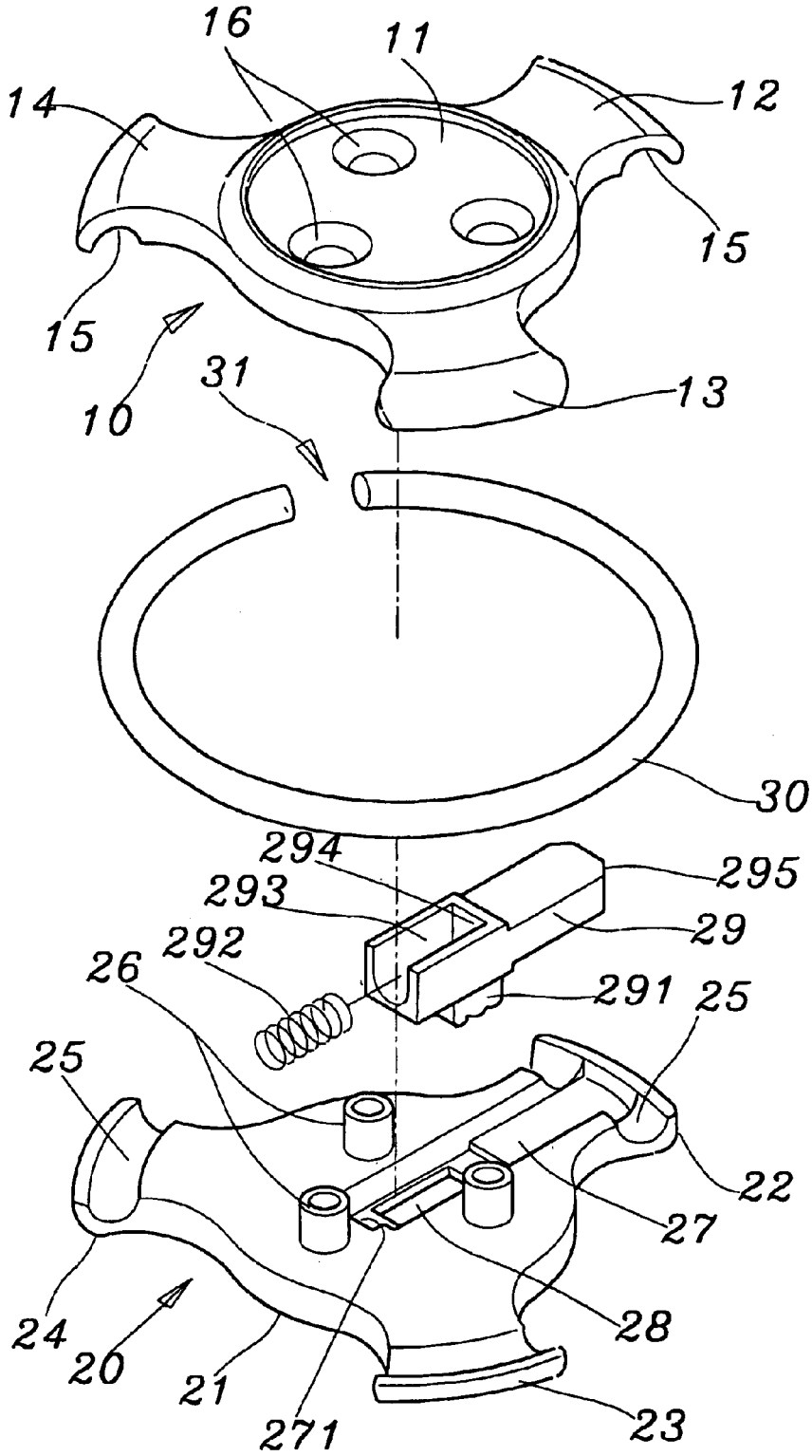
FIG. 2 is an analytic perspective view showing the elements of FIG. 1.
Figure 3:
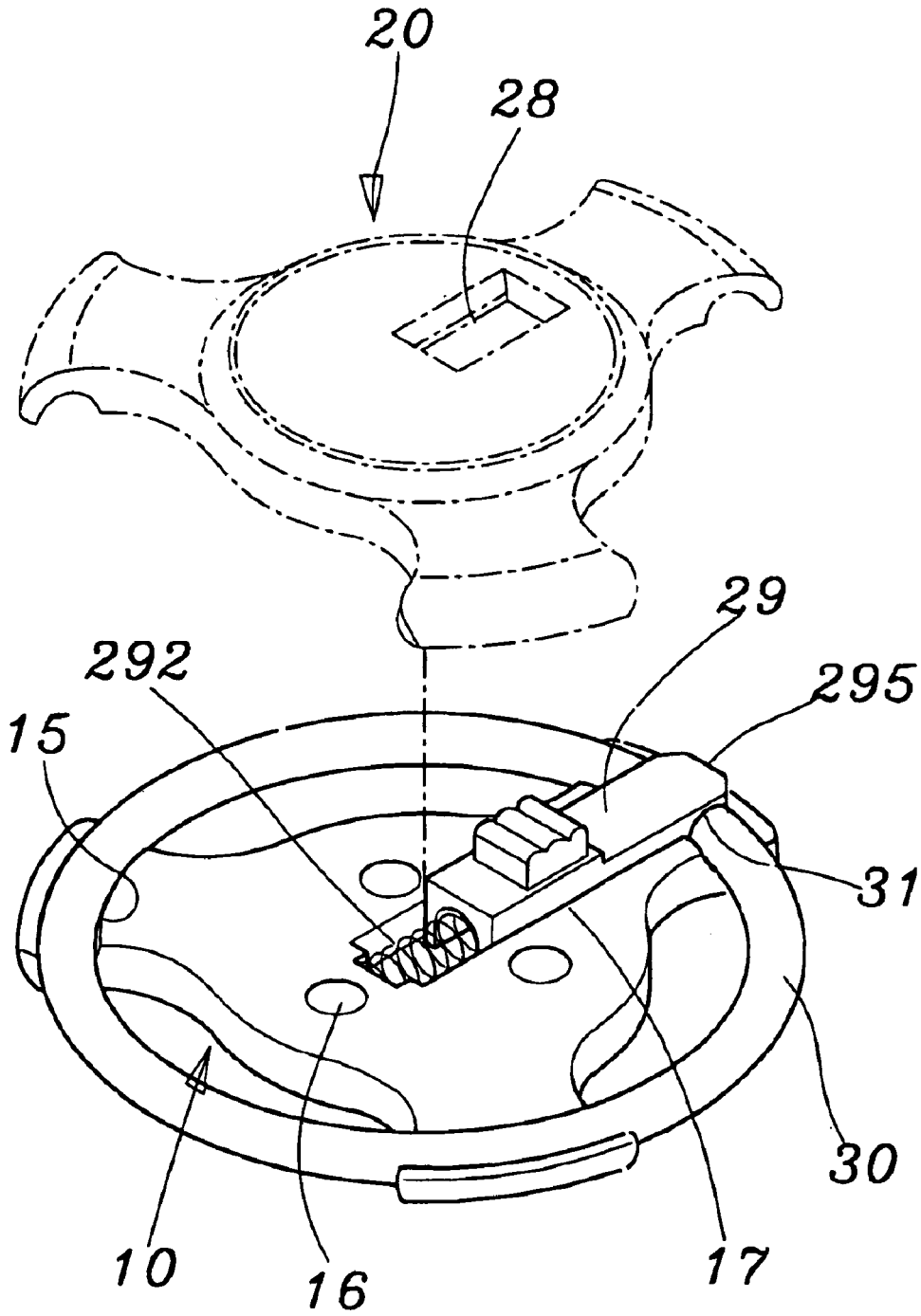
FIG. 3 is a perspective view showing the main structure of the present invention on the rear side of that shown in FIG. 1 with an upper housing detached.

Referring to FIGS. 1–3, in the preferred embodiment shown, the present invention has an upper housing 10 and a lower housing 20 each with a central base portion 11 (21). The central base portions 11, 21 extend radially outwardly to form a plurality of spaced spokes 12, 13, 14 and 22, 23, 24 mutually opposite to the corresponding ones of themselves. These spaced spokes 12, 13, 14 and 22, 23, 24 are provided near the outer edges thereof with pairs of curved recesses 15, 25 mutually opposite to form clamping channels with a round sectional area for each pair.

The base portions 11, 21, the mutually opposite spaced spokes 12, 13, 14 and 22, 23, 24, the pairs of curved recesses 15, 25 and the structure stated below for assembling a slide-controlling member 29 of the upper and lower housings 10, 20 can all be integrally shaped. And for the convenience of manufacturing and assembling, in the preferred embodiment shown, the upper housing 10 is provided on the base portion 11 thereof with a hole 16, while the lower housing 20 is provided on a corresponding position to the hole 16 with a hollow stub 26, so that the upper and lower housings 10, 20 can be connected integrally by pressing the hollow stub 26 into the hole 16.

As shown in FIGS. 2 and 3, the upper and lower housings 10, 20 can be provided with a pair of mutually opposite recesses 17, 27 in communication with a corresponding one of the curved recesses 25; the recess 27 has near the inner end thereof a window 28 in communication with the surface of the lower housing 20. The slide-controlling member 29 is in the shape in coincident with that of the whole of the mutually opposite recesses 17, 27 but a little shorter, a moving button 291 provided on the surface thereof can be mounted in the window 28 and protrudes from the surface of the lower housing 20 in favor of moving the entire slide-controlling member 29. The slide-controlling member 29 is provided normally to be able of extending to a position in communication with the curved recess 25 by means of an elastic element, or to be able of contracting to get rid of the curved recess 25 when the slide-controlling member 29 is moved externally. In the embodiment shown, the elastic element is a coil spring 292, it can be placed in a recessed chamber 293 near the tailing end of the slide-controlling member 29 to make one end of the coil spring 292 abut against the inner end 294 of the recessed chamber 293 and the other end press against an inner end 271 of the whole of the mutually opposite recesses 17, 27; the coil spring 292 thereby normally is compressed to push the slide-controlling member 29.

An annular ring 30 is provided, it has a diameter in coincident with that of the clamping channels formed by connecting of the pairs of mutually opposite curved recesses 15, 25, while the diameter of the sectional area of the ring is a little bit smaller than that of a clamping channel formed by connecting of a pair of curved recesses 15, 25. The annular ring 30 with a notch 31 thereby can be movably positioned in the clamping channels formed by connecting of the pairs of mutually opposite curved recesses 15, 25.

Figure 4:
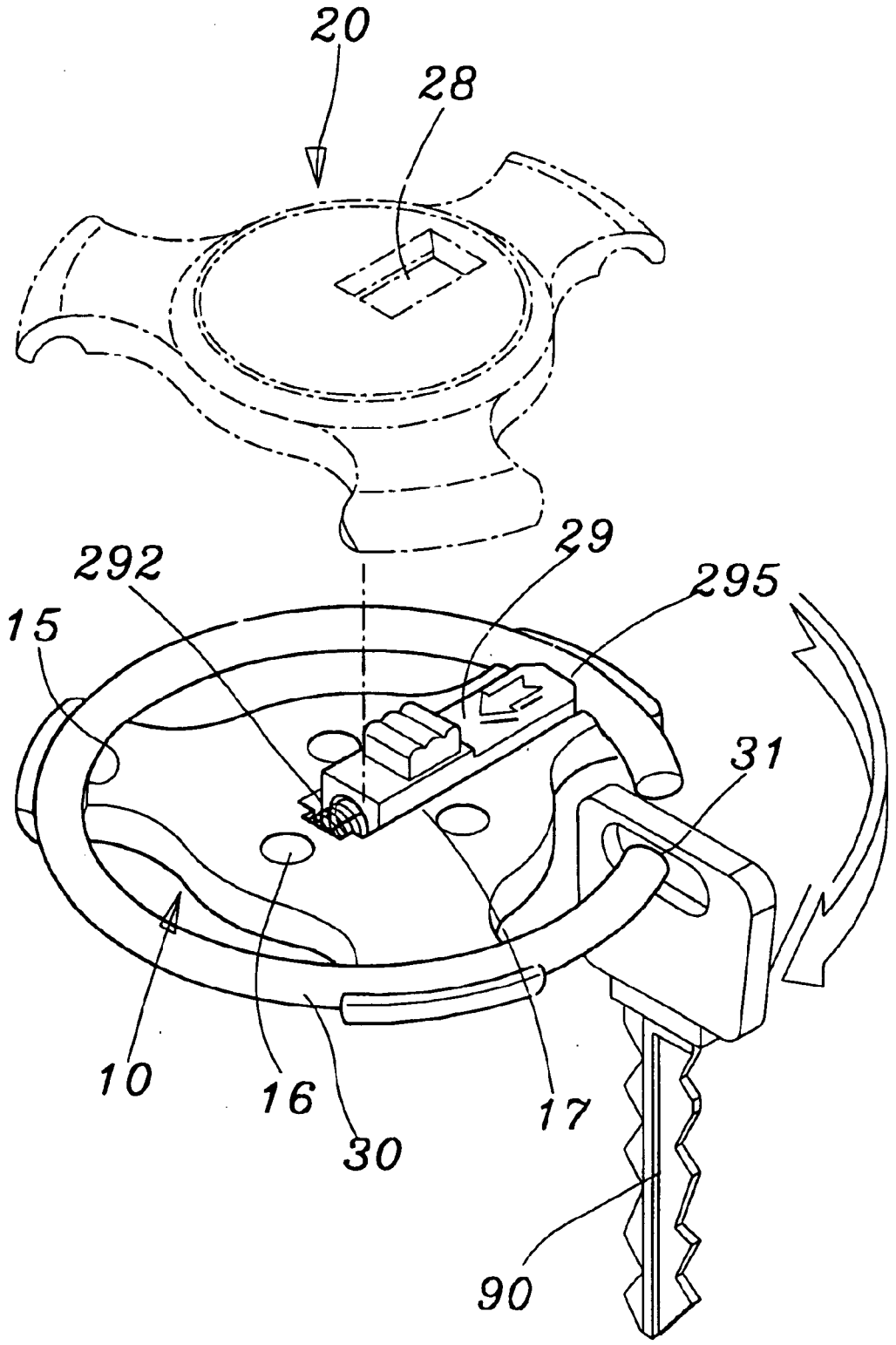
FIG. 4 is a perspective view showing assembling and disassembling of the present invention as shown in FIG. 3.

When the annular ring 30 is rotated by a force into the space between two pairs of mutually opposite spaced spokes 12, 22, and a front end 295 of the slide-controlling member 29 is stretched elastically into the notch 31 (referring to FIG. 3), the annular ring 30 is in a normal closing state. On the contrary, when the exposed moving button 291 makes contracting of the slide-controlling member 29 (referring to FIG. 4), the notch 31 of the annular ring 30 is rotated into a none-blocking operation space between the two pairs of mutually opposite spaced spokes 12, 22. Thereby, the notch 31 is in the completely opened state, and a key 90 can be placed in or taken out of the notch 31. After mounting or removing of the key 90, the annular ring 30 is rotated again to the above stated closing position. The front end 295 of the slide-controlling member 29 can be an inclined portion with a smaller width in favor of elastic stretching of the slide-controlling member 29 into the notch 31 when the annular ring 30 is rotated in.

Figure 5:
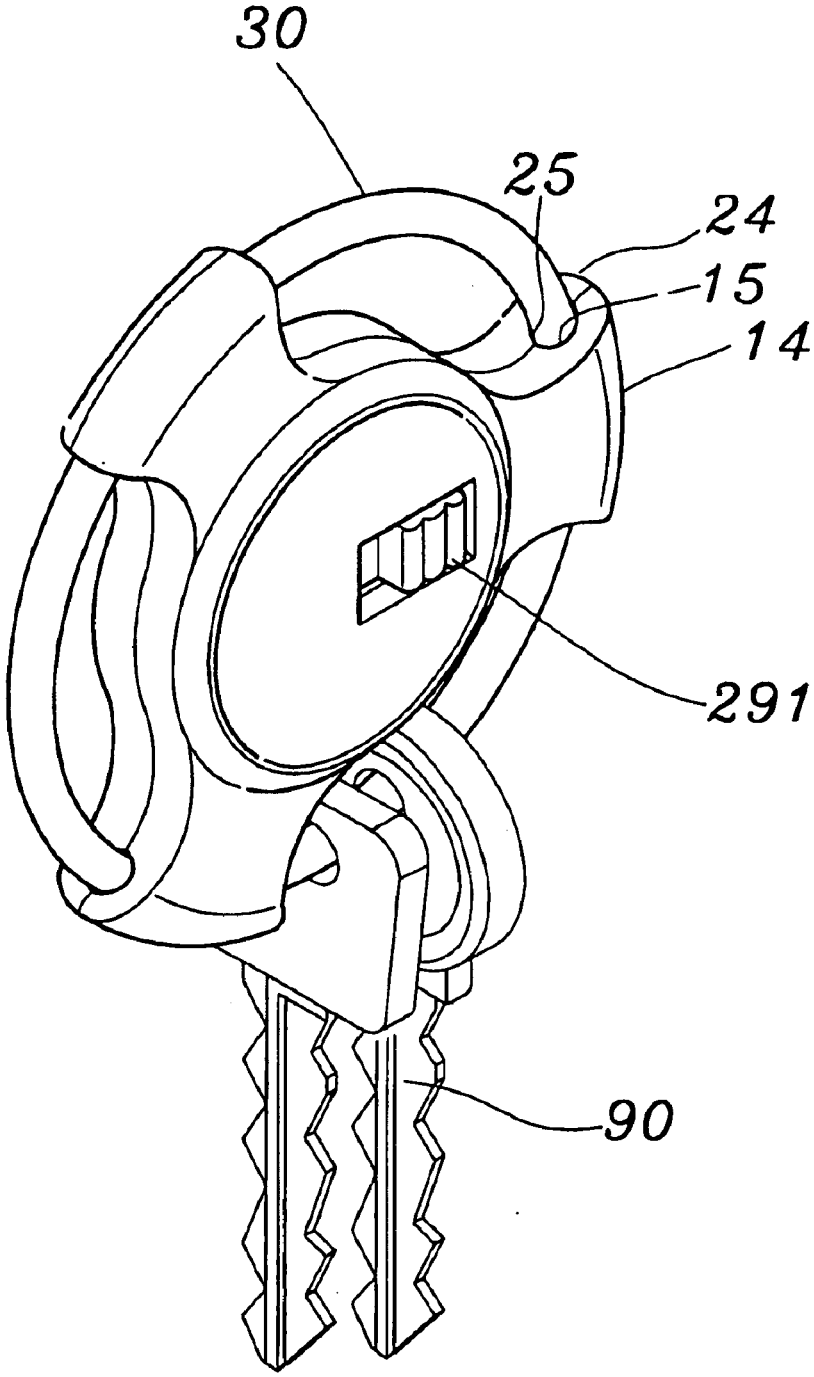
FIG. 5 is a schematic perspective view showing a plurality of keys put in the present invention.

As shown in FIG. 5, the present invention can have a none-blocking operation space between every two pairs of mutually opposite spaced spokes for collecting and tidying keys of various types.

The improved structure of the present invention stated above can be easier and more convenient for use by virtue that the space for operation after rotating the notch of the annular ring out for mounting and detaching keys is enlarged. And the annular ring with the empty inner space is movably clamped on a plurality of spaced spokes, its structural strength thus is increased and can effectively prevent occurrence of damage because of accidental collision; the annular ring of a larger diameter is integral with the main body of the present invention, thereby the present invention has a more ideal entire esthetic appearance.

The embodiments described are only for illustrating the present invention, and not for giving any limitation to the scope of the present invention. It will be apparent to those skilled in this art that various modifications or changes made to the elements of the present invention without departing from the spirit of it shall fall within the scope of the appended claims.

What is claimed is:

1. An annular key collecting device comprising:

a) an upper housing having:

i) a first circular base portion;

ii) a plurality of circumferentially spaced apart upper spokes extending outwardly from the first circular base portion, each of the plurality of spaced apart upper spokes having a curved upper recess; and iii) a first slide member recess communicating with the curved upper recess of one of the plurality of spaced apart upper spokes;

b) a lower housing having:

i) a second circular base portion connected to the first circular base portion;

ii) a plurality of circumferentially spaced apart lower spokes extending outwardly from the second circular base portion, each of the plurality of spaced apart lower spokes having a curved lower recess, the curved lower recess of each of the plurality of spaced apart lower spokes matching and aligning with one curved upper recess of the plurality of spaced apart upper spokes to form a clamping channel; and iii) a second slide member recess communicating with the curved lower recess of one of the plurality of spaced apart lower spokes and aligning with the first slide member recess;

c) an annular ring movably inserted into the clamping channel and having a notch therein; and d) a slide-controlling member slidably located in the first and the second slide member recesses, wherein the slide-controlling member is movable between a locked position and an unlocked position, whereby, in the locked position, a front end of the slide-controlling member is located in the clamping channel so as to engage the notch in the annular ring to restrict movement of the annular ring, and, in the unlocked position, the front end of the slide-controlling member is moved out of the clamping channel and the notch in the annular ring allowing movement of the annular ring relative to the upper and lower housings.

2. The annular key collecting device according to claim 1, further comprising a resilient member located in a recessed chamber of the slide-controlling member, wherein the resilient member presses against an inner end of the slide-controlling member at a first end, and inner ends of the first and second slide member recesses.

3. The annular key collecting device according to claim 2, wherein the resilient member is a spring.

4. The annular key collecting device according to claim 1, wherein the slide-controlling member includes a moving button, one of the first circular base portion and the second circular base portion includes a window, the moving button extending through the window and so as to be moveable between the locked and the unlocked positions, from exteriorly of the key collecting device.

5. The annular key collecting device according to claim 1, wherein each curved upper recess is located on an end of each of the plurality of spaced apart upper spokes opposite the first circular base portion, and each curved lower recess is located on an end of each of the plurality of spaced apart lower spokes opposite the second circular base portion.

6. The annular key collecting device according to claim 1, wherein the first circular base portion includes at least one hole, the second circular base portion includes at least one stub, such that the upper circular housing is connected to the lower circular housing by inserting the at least one stub into the at least one hole.

* * * * *